US006481890B1

(12) United States Patent
VandenHeuvel

(10) Patent No.: US 6,481,890 B1
(45) Date of Patent: Nov. 19, 2002

(54) RECLOSABLE ZIPPER HAVING INTERMITTENT THICKENED FLANGE; PACKAGE; AND METHODS

(75) Inventor: Greg VandenHeuvel, Kaukauna, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/906,507

(22) Filed: Jul. 16, 2001

(51) Int. Cl.[7] ..... B65D 33/16

(52) U.S. Cl. ..... 383/64; 383/61.2; 383/210; 24/585.12; 264/177.1; 156/66; 493/211

(58) Field of Search ..... 383/61.2, 63, 64, 383/65, 210, 211; 24/584.1, 585.1, 585.12, 586.1, 399, 400, 430; 264/177.1; 156/66; 493/211, 213

(56) References Cited

U.S. PATENT DOCUMENTS

| | | | | |
|---|---|---|---|---|
| 4,354,541 | A | | 10/1982 | Tilman |
| 4,363,345 | A | | 12/1982 | Scheibner |
| 4,673,383 | A | | 6/1987 | Bentsen |
| 4,731,911 | A | | 3/1988 | Gould |
| 5,012,561 | A | | 5/1991 | Porchia et al. |
| 5,067,822 | A | | 11/1991 | Wirth et al. |
| 5,209,574 | A | | 5/1993 | Tilman |
| 5,216,787 | A | | 6/1993 | Custer et al. |
| 5,238,306 | A | | 8/1993 | Heintz et al. |
| 5,369,847 | A | | 12/1994 | Naya et al. |
| 5,384,942 | A | | 1/1995 | Siegel |
| 5,442,838 | A | * | 8/1995 | Richardson et al. ..... 24/399 |
| 5,470,156 | A | * | 11/1995 | May ..... 383/210 |
| 5,486,255 | A | | 1/1996 | Simonsen |
| 5,509,734 | A | | 4/1996 | Ausnit |
| 5,638,586 | A | * | 6/1997 | Malin et al. ..... 24/584.1 |
| 5,655,273 | A | | 8/1997 | Tomic et al. |
| 5,664,303 | A | | 9/1997 | Johnson |
| 5,747,126 | A | | 5/1998 | Van Erden et al. |
| 6,088,887 | A | * | 7/2000 | Bois ..... 24/399 |
| 6,167,597 | B1 | * | 1/2001 | Malin ..... 24/399 |
| 6,290,393 | B1 | * | 9/2001 | Tomic ..... 24/399 |
| 6,299,353 | B1 | * | 10/2001 | Piechocki et al. ..... 24/324 |
| 6,305,844 | B1 | * | 10/2001 | Bois ..... 24/399 |
| 6,386,760 | B1 | * | 5/2002 | Tomic ..... 383/203 |

FOREIGN PATENT DOCUMENTS

| | | |
|---|---|---|
| JP | 4-339768 | 11/1992 |

* cited by examiner

*Primary Examiner*—Jes F. Pascua
(74) *Attorney, Agent, or Firm*—Julie R. Daulton; Tracey D. Beiriger

(57) ABSTRACT

A zipper closure having a first and second releasably interlocking closure profiles where a first sealing flange extends from the first closure profile, and a second sealing flange extends from the second closure profile. Two rectangular-shaped protrusions are on each of an exterior and interior side of the first sealing flange. A rectangular-shaped protrusion is on each of an exterior and interior side of the second sealing flange. The rectangular-shaped protrusions on each interior side of first and second sealing flange are constructed and arranged to mate with each other. A flexible, reclosable package and methods of manufacturing are also disclosed.

20 Claims, 5 Drawing Sheets

RECLOSABLE ZIPPER HAVING INTERMITTENT THICKENED FLANGE; PACKAGE; AND METHODS

FIELD OF THE DISCLOSURE

This disclosure concerns reclosable packages and their use. In particular, this disclosure describes reclosable zipper closures having an intermittent thickened flange, packages made with the zipper closure, and methods of making the packages.

BACKGROUND

Flexible packages, in particular resealable and reclosable packages, are frequently used for packaging of consumable goods. Goods that are not used completely when the package is initially opened rely on a zipper closure to reclose the package and keep the remaining contents fresh. Examples of consumable goods that are often packaged in packages, such as bags, with a zipper closure include potting soil, fertilizer, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. In some applications, it is desired to include a tamper-evident structure, to notify whether access has been gained to the zipper closure or to the package interior. Improvements in these types of packages are desirable.

SUMMARY OF THE DISCLOSURE

A reclosable zipper arrangement is provided, which includes rectangular-shaped protrusions on an interior and an exterior side of sealing flanges of the zipper closure. This type of arrangement improves a securing or sealing of the zipper closure to film, such as side panels of a bag or package, over conventional types of zipper closures. Further, the provision of rectangular-shaped protrusions improves the alignment of the bag side panels to the zipper closure during manufacture, over conventional arrangements. It is believed that this improvement results due to sealing occurring at specific points rather than across the entire sealing flange area because specific point sealing requires less energy than sealing across the entire sealing flange area. Sealing on specific points also allows higher processing speeds during the sealing process than conventional processing speeds.

In one aspect, a zipper closure arrangement is described, which includes rectangular-shaped protrusions on at least one sealing flange.

In another aspect, a flexible, reclosable package is provided, which includes a zipper closure having rectangular-shaped protrusions on a sealing flange.

In another aspect, a method of making a flexible reclosable package is provided. Preferred methods include techniques that result in structures as described herein.

DETAILED DESCRIPTION

Flexible packages having zipper closures are common in today's packaging market. The zipper closure may have first and second interlocking closure profiles. The zipper closure provides easy opening and closing of the package mouth to gain access to the contents within the package interior. The zipper closure also allows resealing the package to keep the contents fresh.

The addition of rectangular-shaped protrusions on an interior and exterior side of sealing flanges improves the sealing of side panels to the zipper closure and improves the alignment of the side panels to the zipper closure during manufacture. Sealing between the zipper closure and side panels is improved due to the sealing occurring at specified points rather than across the entire zipper sealing flange area. Sealing on specific points (rectangular-shaped protrusions) of the zipper closure requires less energy to accomplish the desired sealing. Sealing on specific points also allows higher processing speeds during the sealing process. The rectangular-shaped protrusions also serve as aligning devices as thickened portions on opposing closure profiles nest with each other. As the opposing rectangular-shaped protrusions mate or nest, this action aids in the alignment of opposing closure profiles. Rectangular-shaped protrusions also reduce the sealing process' effect on tamper-evident structures since less energy is needed to properly seal the side panels to the zipper closure profile and the rectangular-shaped protrusions act as a heat sink with greater mass than would be available without the rectangular-shaped protrusions. The rectangular-shaped protrusions can be continuous or discontinuous along the length of the zipper closure. Rectangular-shaped protrusions can be constructed out of the same material that makes up the zipper closure or rectangular-shaped protrusions can be constructed out of different material than the material that makes up the zipper closure. The rectangular-shaped protrusions can be a single continuous material or the thickened portion can be a laminate type structure with layer of the same or different material than the material that makes up the zipper closure.

The addition of a tamper-evident structure, such as a peel seal, to a flexible package improves the security of the contents within the package, because the tamper-evident structure provides an indication whether the seal has been breached and access has been gained to the interior.

The addition of a slider device to a flexible package such as a bag is advantageous to aging or arthritic persons not having the physical ability to use just a zipper closure to reseal a bag. Additionally, the addition of a slider device to a flexible package facilitates the use of the bag by users of all ages and abilities.

Figure 1:
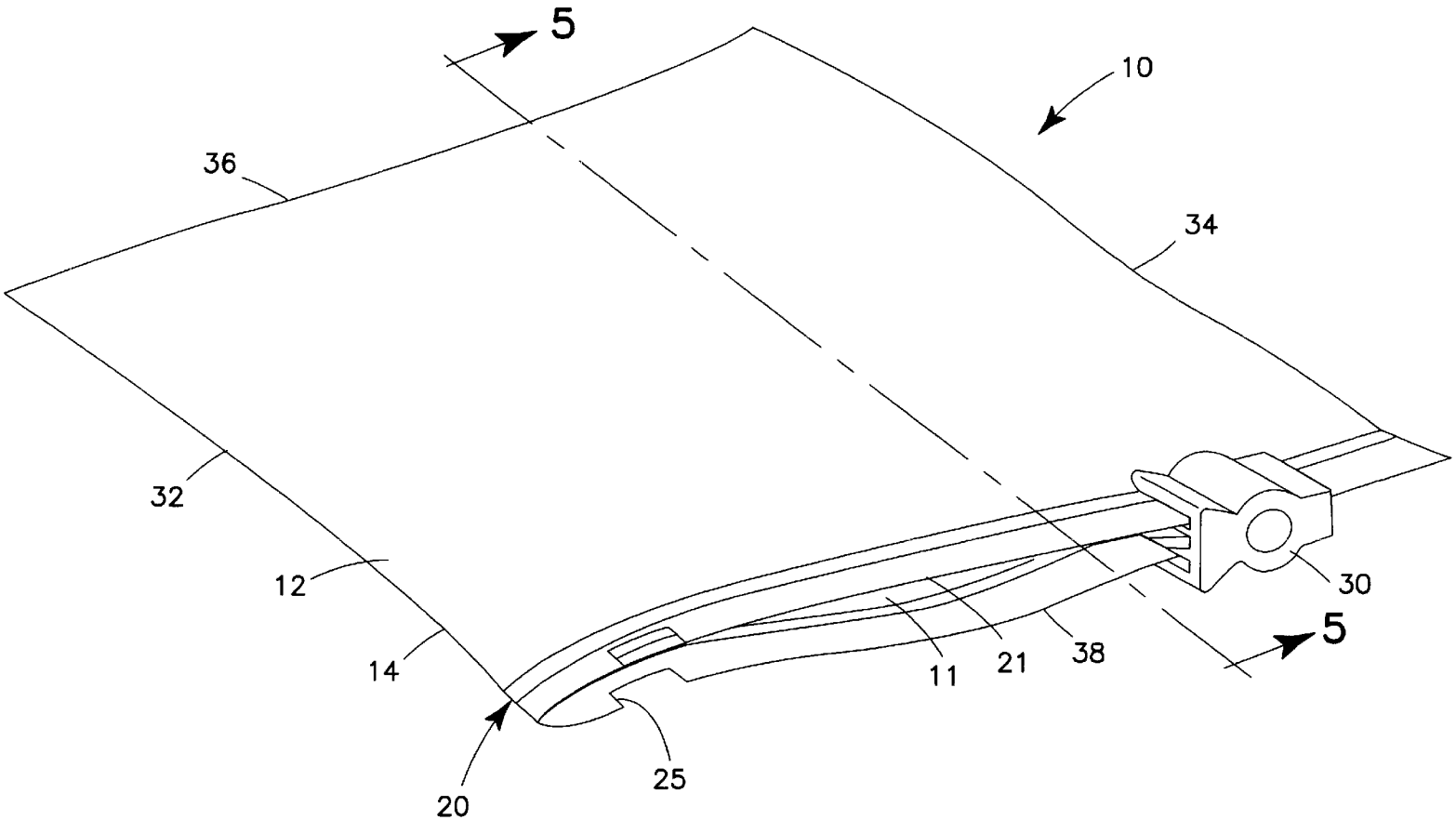
FIG. 1 is a perspective view of a flexible, reclosable package having a zipper closure and a slider device.

A flexible, reclosable package 10 is shown in FIG. 1. Package 10 has a package wall comprising first and second polymeric film side panels 12 and 14 defining an interior 11.

Package 10 includes three edges, side edges 32, 34 and bottom edge 36, where side panels 12, 14 are connected to each other to form interior 11 of package 10. First side edge 32 and second side edge 34 are seals created by the application of heat and pressure for a set time period to side panels 12, 14. In an alternate embodiment, at least one of first side edge 32 and second side edge 34 is a fold line, where a single sheet of film is folded to form the two side panels 12, 14. In FIG. 1, bottom edge 36 is a fold line between side panels 12, 14, which is formed when a single sheet of film is folded to form the two side panels; in another embodiment, bottom edge 36 is a seal created by the application of heat and pressure to side panels 12, 14 for a desired time period. In yet a further embodiment, a tube of material can be used as side panels 12, 14, so that each of first side edge 32 and second side edge 34 are fold lines.

Bottom edge 36 can include a gusset (not shown). A gusset can be included to provide the package with a stand-up feature or to increase the volume of interior 11. The gusset may be a sealed gusset, where the two sides are sealed together along the length of the gusset or only a portion of the length, or the gusset panels may be non-sealed.

A zipper closure arrangement 20 having mating closure profiles to open and close (unseal and reseal) the first and second side panels 12, 14 of package 10 extends between side edge 32 and side edge 34 along top edge 38 of package 10. Zipper closure 20 opens and closes mouth 21 and provides access to interior 11. A slider device 30 is shown positioned on zipper closure 20 to facilitate opening and closing of zipper closure 20 at mouth 21.

Figure 2:
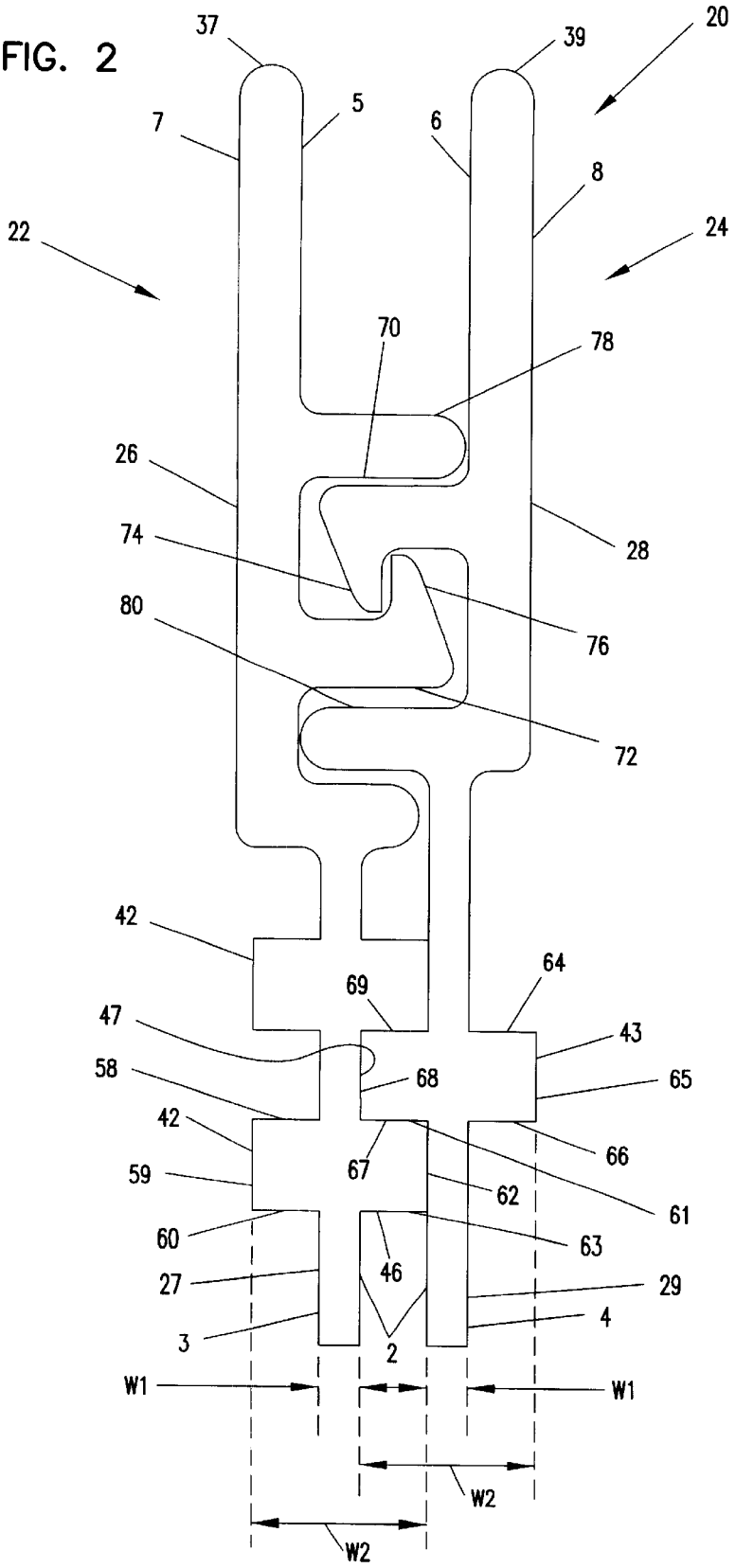
FIG. 2 is an enlarged cross-sectional view of an embodiment of a zipper closure usable with the package of FIG. 1, without the slider device mounted thereon.

Zipper closure 20 can include a variety of configurations and structures. In FIG. 2, zipper closure 20 is shown in detail without slider device 30. Zipper closure 20 has a first closure profile 22 and a second closure profile 24. In particular, first closure profile 22 has first interlocking profile 26 and second closure profile 24 has second interlocking profile 28. First and second interlocking profiles 26, 28 interlock to provide a seal across mouth 21 (FIG. 1).

First and second closure profiles 22, 24 include first and second sealing flanges 27, 29 respectively. First and second sealing flanges 27, 29 are directed toward a flexible bag interior 11 when constructed as part of a bag having an interior 11 and extending from interlocking closure profiles 26, 28. First and second sealing flanges 27, 29 are provided to secure closure profiles 22, 24 to side panels 12, 14. First sealing flange 27 has an interior side 1 and an exterior side 3. Second sealing flange 29 has an interior side 2 and an exterior side 4. When first and second interlocking closure profiles 26, 28 are engaged with each other, first sealing flange 27 interior side 1 faces second sealing flange 29 interior side 2. First and second sealing flange 27, 29 each have a first cross-sectional width $w_1$.

First and sealing flange 27, 29 can include interior side 1, 2 rectangularshaped protrusions 46, 47 that mate or nest together. In FIG. 2, first sealing flange 27 has two rectangular-shaped protrusions 42, 46 extending from each of the interior side 1 and exterior side 2. Second sealing flange 29 can include a rectangular-shaped protrusion 43, 47 extending from each of the interior side 2 and exterior side 4. The rectangular-shaped protrusions 42, 43, 46, 47 have a second cross-sectional width $w_2$ greater than the first and second sealing flange 27, 29 first cross-sectional width $w_1$. First sealing flange 27 and second sealing flange 29 may have more than two rectangular-shaped protrusion 42, 43, 46, 47 on each interior 1, 2 and exterior side 3, 4 of sealing flange 27, 29.

First sealing flange 27 exterior side 3 rectangular-shaped protrusion 42 includes a first and second exterior side wall 58, 60 perpendicular to the first sealing flange exterior side 3 and extending away from the first sealing flange exterior side 3. An exterior end wall 59 extends from the first exterior side wall 58 to the second exterior side wall 60 and parallel to the first sealing flange exterior side 3. First sealing flange 27 interior side 1 rectangular-shaped protrusion 46 includes a first and second interior side wall 61, 63 perpendicular to the first sealing flange interior side 1 and extending away from the sealing flange interior side 1. The first exterior side wall 58 and first interior side wall 61 extend in a horizontal plane. The second exterior side wall 60 and second interior side wall 63 extend in a second horizontal plane. An interior end wall 62 extends from the first interior side wall 61 to the second interior side wall 63 and is parallel to first sealing flange interior side 1.

Second sealing flange 29 exterior side 4 rectangular-shaped protrusion 43 includes a first and second exterior side wall 64, 66 perpendicular to the second sealing flange exterior side 4 and extending away from the second sealing flange exterior side 4. An exterior end wall 65 extends from the first exterior side wall 64 to the second exterior side wall 66 and is parallel to the second sealing flange exterior side 4. Second sealing flange 29 interior side 2 rectangular-shaped protrusion 47 includes a first and second interior side wall 69, 67 perpendicular to the second sealing flange interior side 2 and extending away from the second sealing flange interior side 2. The first exterior side wall 64 and first interior side wall 69 extend in a horizontal plane. The second exterior side wall 66 and second interior side wall 67 extend in a second horizontal plane. An interior end wall 68 extends from the first interior side wall 69 to the second interior side wall 67 and is parallel to second sealing flange interior side 2.

First and second closure profiles 22, 24 include first and second distal flanges 37, 39 respectively. First and second distal flanges 37, 39 are directed away from flexible bag interior 11 when constructed as part of a bag having interior 11 and extending from interlocking closure profiles 26, 28. First distal flange 37 has an interior side 5 and an exterior side 7. Second distal flange 39 has an interior side 6 and an exterior side 8. When first and second interlocking closure profiles 26, 28 are engaged with each other, first distal flange 37 interior side 5 faces second distal flange 39 interior side 6.

Zipper closure 20 can be configured in any known manner, for example, as disclosed in U.S. Pat. Nos. 4,340,341; 4,346,288; and 4,437,293; each of which is incorporated by reference herein. First closure profile 22 and second closure profile 24 engage and disengage, as appropriate, to open and close package 10. In particular, each of the profiles 22, 24 includes profile members 70, 72 with hooks 74, 76 to catch each other. Further, each of the profiles 22, 24 includes posts 78, 80 to help with sealing.

In FIG. 1, slider device 30 can optionally be mounted on zipper closure 20 to facilitate opening and closing of zipper closure 20. Slider devices and how they function to open and close zipper closures, in general, are taught, for example, in U.S. Pat. Nos. 5,063,644; 5,301,394; 5,442,837, and 5,664,329, each of which is incorporated by reference herein. An exemplary slider device is taught in WO 00/28851 published May 25, 2000, and U.S. Pat. No. Des. 434,345 issued Nov. 28, 2000, all which are incorporated herein by reference in their entirety. Although shown schematically in FIGS. 1 and 5, slider device 30, 330 can be constructed and arranged in accordance with the disclosures of patent publication WO 00/28851 and U.S. Pat. No. Des. 434,345.

Still referring to FIG. 1, a notch 25 can be disposed within zipper closure 20. Notch 25 is designed to provide a "park place" into which slider device 30 settles when zipper closure 20 is sealed. Such a notch 25 may decrease any tendency for an incomplete interlock between first closure profile 22 and second closure profile 24. Examples of notches are disclosed, for example, in U.S. Pat. Nos. 5,067,208 and 5,301,395, each of which is incorporated by reference herein.

Figure 3:
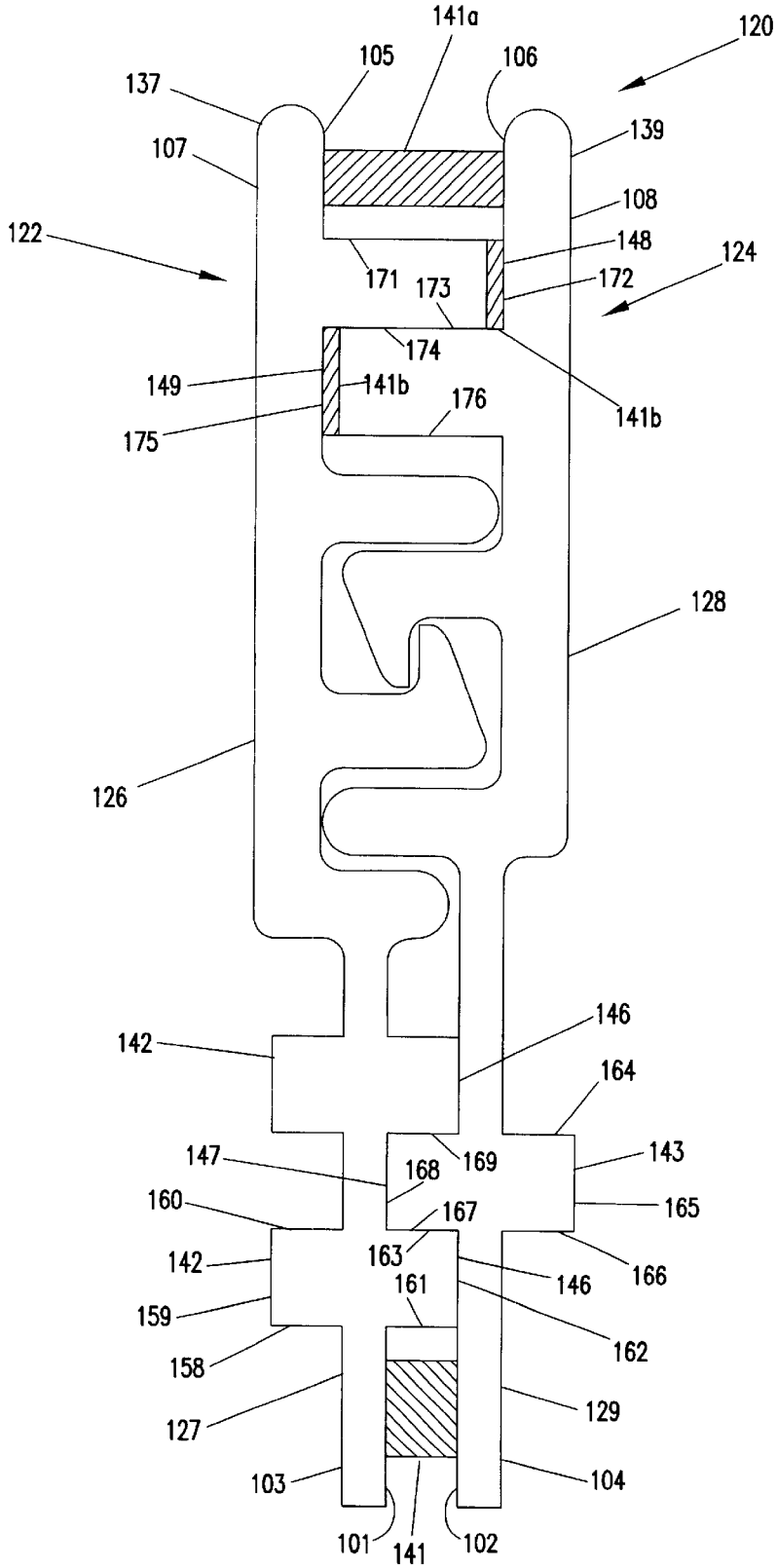
FIG. 3 is a enlarged cross-sectional view of another embodiment of a zipper closure usable with the package of FIG. 1, without the slider device mounted thereon, similar to the view of FIG. 2.

In FIG. 3, another embodiment of a zipper closure 120 is shown. Zipper closure 120 has a first closure profile 122 and a second closure profile 124. In particular, first closure profile 122 has first interlocking profile 126 and second closure profile 124 has second interlocking profile 128. First and second interlocking profiles 126, 128 interlock to provide a seal across mouth 21 (FIG. 1).

First and second closure profiles 122, 124 include first and second sealing flanges 127, 129 respectively. First and second sealing flanges 127, 129 are directed toward a flexible bag interior 11 when constructed as part of a bag having an interior 11 and extending from interlocking closure profiles 126, 128. First and second sealing flanges 127, 129 are provided to secure closure profiles 122, 124 to side panels 12, 14. First sealing flange 127 has an interior side 101 and an exterior side 103. Second sealing flange 129 has an interior side 102 and an exterior side 104. When first and second interlocking closure profiles 126, 128 are engaged with each other, first sealing flange 127 interior side 101 faces second sealing flange 129 interior side 102. First and second sealing flange 127, 129 each have a first cross-sectional width $w_1$ (not illustrated in FIG. 3, but analogous to that shown in FIG. 2).

First and second sealing flange 127, 129 include interior side 101, 102 rectangular-shaped protrusions 146, 147 that mate or nest together. In FIG. 3, first sealing flange 127 has two rectangular-shaped protrusions 142, 146 extending from each of the interior side 101 and exterior side 102. Second sealing flange 129 includes a rectangular-shaped protrusion 143, 147 extending from each of the interior side 102 and exterior side 104. The rectangular-shaped protrusions 142, 143, 146, 147 have a second cross-sectional width $w_2$ (not shown in FIG. 3, but analogous to FIG. 2) greater than the first and second sealing flange 127, 129 first cross-sectional width $w_1$. First sealing flange 127 and second sealing flange 129 may have more than two rectangular-shaped protrusion 142, 143, 146, 147 on each interior 101, 102 and exterior side 103, 104 of sealing flange 127, 129.

First sealing flange 127 exterior side 103 rectangular-shaped protrusion 142 includes a first and second exterior side wall 158, 160 perpendicular to the first sealing flange exterior side 103 and extending away from the first sealing flange exterior side 103. An exterior end wall 159 extends from the first exterior side wall 158 to the second exterior side wall 160 and is parallel to the first sealing flange exterior side 103. First sealing flange 127 interior side 101 rectangular-shaped protrusion 146 includes a first and second interior side wall 161, 163 perpendicular to the first sealing flange interior side 101 and extending away from the sealing flange interior side 101. The first exterior side wall 158 and first interior side wall 161 extend in a horizontal plane. The second exterior side wall 160 and second interior side wall 163 extend in a second horizontal plane. An interior end wall 162 extends from the first interior side wall 161 to the second interior side wall 163 and is parallel to first sealing flange interior side 101.

Second sealing flange 129 exterior side 104 rectangular-shaped protrusion 143 includes a first and second exterior side wall 164, 166 perpendicular to the second sealing flange exterior side 104 and extending away from the second sealing flange exterior side 104. An exterior end wall 165 extends from the first exterior side wall 164 to the second exterior side wall 166 and is parallel to the second sealing flange exterior side 104. Second sealing flange 129 interior side 102 rectangular-shaped protrusion 147 includes a first and second interior side wall 169, 167 perpendicular to the second sealing flange interior side 102 and extending away from the second sealing flange interior side 102. The first exterior side wall 164 and first interior side wall 169 extend in a horizontal plane. The second exterior side wall 166 and second interior side wall 167 extend in a second horizontal plane. An interior end wall 168 extends from the first interior side wall 169 to the second interior side wall 167 and is parallel to second sealing flange interior side 102.

First and second closure profiles 122, 124 include first and second distal flanges 137, 139 respectively. First and second distal flanges 137, 139 are directed away from a flexible bag interior 11 when constructed as part of a bag having an interior 11 and extending from interlocking closure profiles 126, 128. First distal flange 137 has an interior side 105 and an exterior side 107. Second distal flange 139 has an interior side 106 and an exterior side 108. When first and second interlocking closure profiles 126, 128 are engaged with each other, first distal flange 137 interior side 105 faces second distal flange 139 interior side 106.

First distal flange 137 interior side 105 rectangular-shaped protrusion 148 includes a first and second interior side wall 171, 173 perpendicular to the first distal flange interior side 105 and extending away from the second distal flange interior side 105. An interior end wall 172 extends from the first interior side wall 171 to the second interior side wall 173 and is parallel to first distal flange interior side 105.

Second distal flange 139 interior side 106 rectangular-shaped protrusion 149 includes a first and second interior side wall 174, 176 perpendicular to the second distal flange interior side 106 and extending away from the second distal flange interior side 106. An interior end wall 175 extends from the first interior side wall 174 to the second interior side wall 176 and is parallel to second distal flange interior side 106.

A peel seal 141 can be located on the first and second sealing flanges 127, 129, on the first and second distal flanges 137, 139 or on both the first and second sealing flanges 127, 129 and first and second distal flanges 137, 139. The peel seal 141 can be positioned on and secured to an interior side 101, 102 of sealing flanges 127, 129 of zipper closure 120 below first and second interlocking profiles 126, 128. Optionally, the peel seal 141a can be positioned on and secured to an interior side 105, 106 of distal flanges 137, 139 of zipper closure 120 above first and second interlocking profiles 126, 128. A peel seal 141b can be optionally positioned on interior side rectangular-shaped protrusions 146, 147, 148, 149.

Peel seal 141 is preferably a tamper-evident structure; by "tamper-evident", it is meant that it provides an indication to the consumer as to whether the package 10 has been previously opened and access gained to the interior 11 (FIG. 1). Peel seal 141 can extend from first side edge 32 (FIG. 1) to second side edge 34 (FIG. 1), providing a barrier between zipper closure 20 (FIG. 1) and interior 11 (FIG. 1) of the package 10 (FIG. 1). Peel seal 141 can be a hermetic seal.

A permanent bond or seal exists between peel seal 141 and sealing and distal flanges 127, 129, 139, 139 at interior sides 101, 102, 105, 106; the strength of this bond or seal can be measured by the force needed to break the bond. In order to access interior 11 (FIG. 1) of package 10 (FIG. 1), peel seal 141 needs to be penetrated. Peel seal 141 has an internal strength that is less than the strength of the seals between peel seal 141 and sealing and distal flanges 127, 129, 137, 139 at interior sides 101, 102, 105, 106. By "internal strength", it is meant that a certain force is needed to rupture, cleave, split, delaminate, or otherwise separate peel seal 141 within its structure between interior sides 101, 102, 105, 106. Typically, this internal strength is about 1.5 to 2 pounds per inch of peel seal (about 0.27 to about 0.36 kg per cm), although higher strengths are preferred for large packages, and small packages could have a lower internal peel seal strength. Since there is a tendency to break at the weakest point, peel seal 141 will cleave internally, within itself, rather than at the areas where peel seal 141 is secured to interior sides 101, 102, 105, 106, specifically, to sealing or distal flanges 127, 129, 137, 139 in FIG. 3. Thus, upon penetration of peel seal 141, peel seal 141 will split internally, leaving a portion of peel seal 141 connected to each sealing or distal flange 127, 129, 137, 139 at interior sides 101, 102, 105, 106.

In particular, peel seal 141 of FIG. 3 is generally a peelable film. A "peelable film" generally consists of multiple layers, typically 2 to 5 layers, which, when a force of a predetermined magnitude is applied, delaminates or otherwise splits between at least two of the multiple layers. Generally there are at least 3 layers. This delamination between any two layers is internal to the overall peelable film. However, if one of the layers tears within itself, this is also considered an internal split. The various layers of peelable films may be made from different or the same polymeric materials. For example, a peelable film with two layers can have both layers made from the same material; or, the two layers can be made from different materials.

Figure 5:
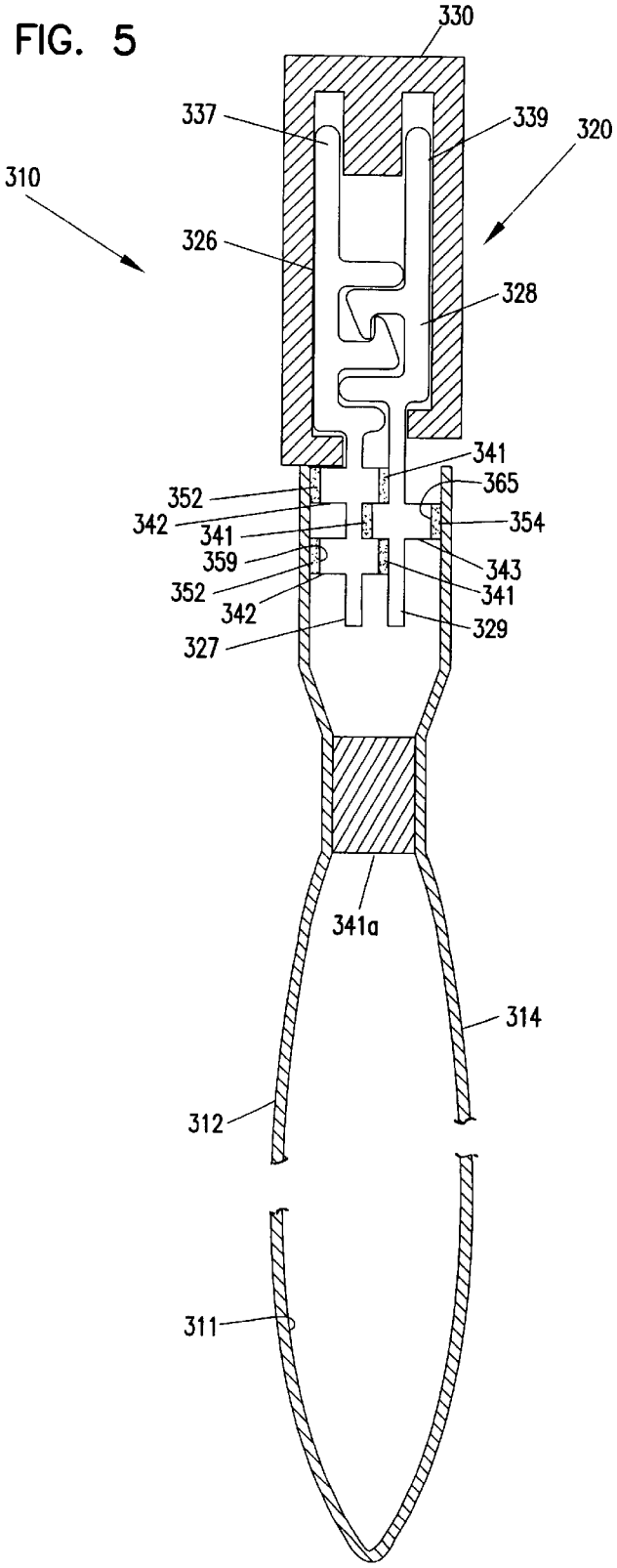
FIG. 5 is a cross-sectional view of another embodiment of a flexible, eclosable package having a slider device mounted thereon and a peel seal, the cross-section being analogous to the view taken along line 5—5 of FIG. 1.

The multiple layers of peelable film can be provided simultaneous during extrusion of the peelable film; that is, the layers of peelable film may be co-extruded. Individual layers can also be laminated together to provide a peelable film. The various layers may have the same or different colors. The internal bonding strength between and/or within the multiple layers, whether co-extruded or laminated, is generally less than the bonding strength between the outer surfaces of peelable film and other polymeric surfaces such as sealing or distal flanges 127, 129, 137, 139 or side panels 12, 14 (FIG. 5). When the peelable film is breached, the peelable film delaminates or tears internally, either between two layers or within a single layer, while leaving the seal between peelable film outer surfaces and sealing or distal flanges 127, 129, 137, 139 intact. A color change may occur when the peelable film delaminates or tears, visually indicating the breach.

Figure 4:
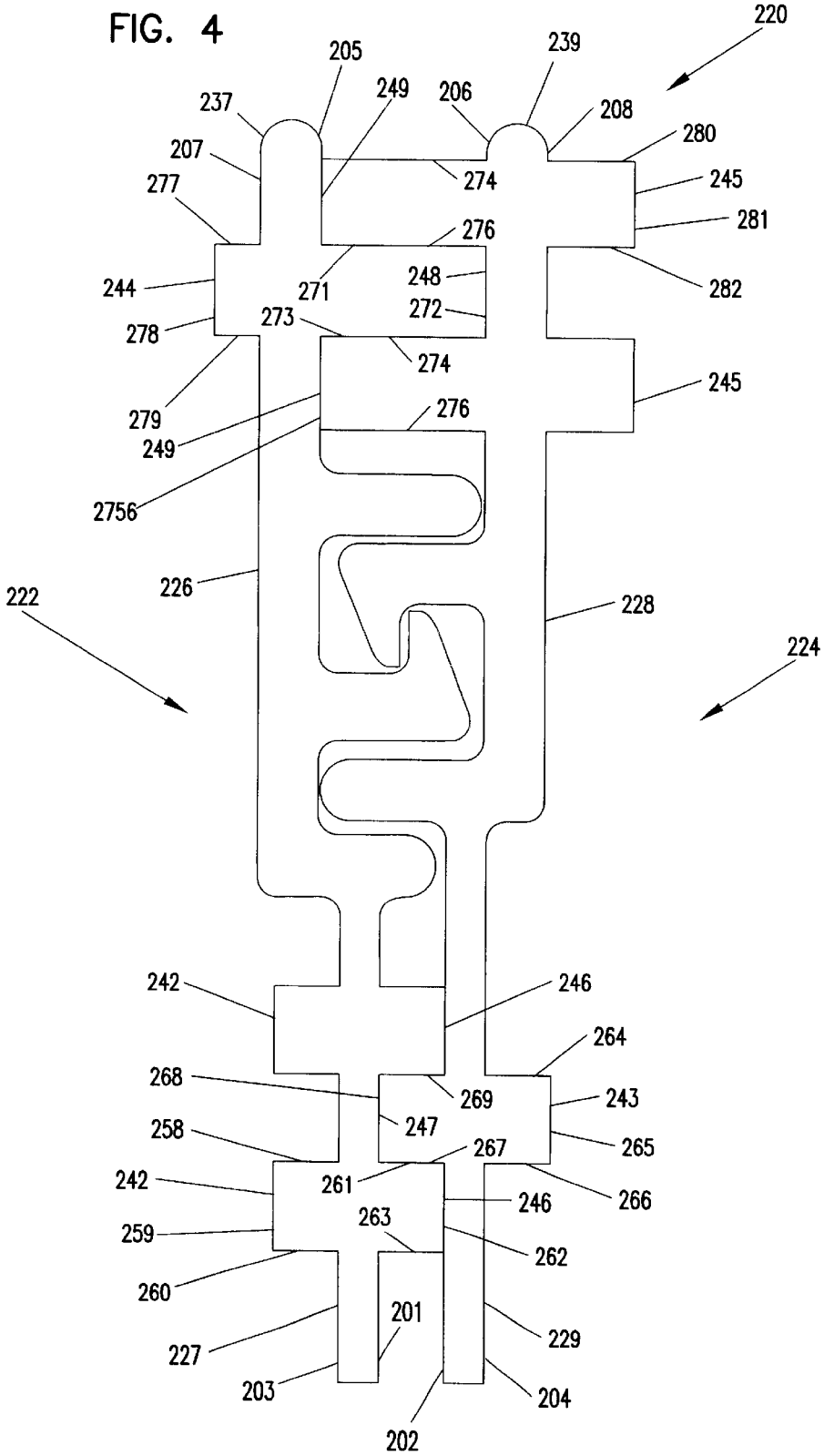
FIG. 4 is a enlarged cross-sectional view of another embodiment of a zipper closure usable with the package of FIG. 1, without the slider device mounted thereon, similar to the view of FIG. 2.

In FIG. 4, another embodiment of a zipper closure 220 is shown. Zipper closure 220 has a first closure profile 222 and a second closure profile 224. In particular, first closure profile 222 has first interlocking profile 226 and second closure profile 224 has second interlocking profile 228. First and second interlocking profiles 226, 228 interlock to provide a seal across mouth 21 (FIG. 1).

First and second closure profiles 222, 224 include first and second sealing flanges 227, 229 respectively. First and second sealing flanges 227, 229 are directed toward flexible bag interior 11 when constructed as part of a bag having an interior 11 and extending from interlocking closure profiles 226, 228. First and second sealing flanges 227, 229 are provided to secure closure profiles 222, 224 to side panels 12, 14. First sealing flange 227 has an interior side 201 and an exterior side 203. Second sealing flange 229 has an interior side 202 and an exterior side 204. When first and second interlocking closure profiles 226, 228 are engaged with each other, first sealing flange 227 interior side 201 faces second sealing flange 229 interior side 202. First and second sealing flange 227, 229 each have a first cross-sectional width $w_1$ (analogous to that shown in FIG. 2).

First and second sealing flange 227, 229 can include interior side 201, 202 rectangular-shaped protrusions 246, 247 that mate or nest together. In FIG. 4, first sealing flange 227 has two rectangular-shaped protrusions 242, 246 extending from each of the interior side 201 and exterior side 202. Second sealing flange 229 can include a rectangular-shaped protrusion 243, 247 extending from each of the interior side 202 and exterior side 204. The rectangular-shaped protrusions 242, 243, 246, 247 have a second cross-sectional width $w_2$ (analogous to that shown in FIG. 2) greater than the first and second sealing flange 227, 229 first cross-sectional width $w_1$. First sealing flange 227 and second sealing flange 229 may have more than two rectangular-shaped protrusion 242, 243, 246, 247 on each interior 201, 202 and exterior side 203, 204 of sealing flange 227, 229.

First sealing flange 227 exterior side 203 rectangular-shaped protrusion 242 includes a first and second exterior side wall 258, 260 perpendicular to the first sealing flange exterior side 203 and extending away from the first sealing flange exterior side 203. An exterior end wall 259 extends from the first exterior side wall 258 to the second exterior side wall 260 and is parallel to the first sealing flange exterior side 203. First sealing flange 227 interior side 201 rectangular-shaped protrusion 246 includes a first and second interior side wall 261, 263 perpendicular to the first sealing flange interior side 201 and extending away from the sealing flange interior side 201. The first exterior side wall 258 and first interior side wall 261 extend in a horizontal plane. The second exterior side wall 260 and second interior side wall 263 extend in a second horizontal plane. An interior end wall 262 extends from the first interior side wall 261 to the second interior side wall 263 and is parallel to first sealing flange interior side 201.

Second sealing flange 229 exterior side 204 rectangular-shaped protrusion 243 includes a first and second exterior side wall 264, 266 perpendicular to the second sealing flange exterior side 204 and extending away from the second sealing flange exterior side 204. An exterior end wall 265 extends from the first exterior side wall 264 to the second exterior side wall 266 and is parallel to the second sealing flange exterior side 204. Second sealing flange 229 interior side 202 rectangular-shaped protrusion 247 includes a first and second interior side wall 269, 267 perpendicular to the second sealing flange interior side 202 and extending away from the second sealing flange interior side 202. The first exterior side wall 264 and first interior side wall 269 extend in a horizontal plane. The second exterior side wall 266 and second interior side wall 267 extend in a second horizontal plane. An interior end wall 268 extends from the first interior side wall 269 to the second interior side wall 267 and is parallel to second sealing flange interior side 202.

First and second closure profiles 222, 224 include first and second distal flanges 237, 239 respectively. First and second distal flanges 237, 239 are directed away from flexible bag interior 11 when constructed as part of a bag having an interior 11 and extending from interlocking closure profiles 226, 228. First distal flange 237 has an interior side 205 and an exterior side 207. Second distal flange 239 has an interior side 206 and an exterior side 208. When first and second interlocking closure profiles 226, 228 are engaged with each other, first distal flange 237 interior side 205 faces second distal flange 239 interior side 206.

First distal flange 237 exterior side 207 rectangular-shaped protrusion 244 includes a first and second exterior side wall 277, 279 perpendicular to the first distal flange exterior side 207 and extending away from the first distal flange exterior side 207. An exterior end wall 278 extends from the first exterior side wall 277 to the second exterior side wall 279 and is parallel to the first distal flange exterior side 207. First distal flange 237 interior side 205 rectangular-shaped protrusion 248 includes a first and second interior side wall 271, 273 perpendicular to the first distal flange interior side 205 and extending away from the second distal flange interior side 205. An interior end wall 272 extends from the first interior side wall 271 to the second interior side wall 273 and is parallel to first distal flange interior side 205.

Second distal flange 239 exterior side 208 rectangular-shaped protrusion 245 includes a first and second exterior side wall 280, 282 perpendicular to the second distal flange exterior side 208 and extending away from the second distal flange exterior side 208. An exterior end wall 281 extends from the first exterior side wall 280 to the second exterior side wall 282 and parallel to the second distal flange exterior side 208. Second distal flange 239 interior side 206 rectangular-shaped protrusion 249 includes a first and second interior side wall 274, 276 perpendicular to the second distal flange interior side 206 and extending away from the second distal flange interior side 206. An interior end wall 275 extends from the first interior side wall 274 to the second interior side wall 276 and is parallel to second distal flange interior side 206.

In FIG. 5, another embodiment of a zipper closure 320, flexible package 310, and slider device 330 is shown. Zipper closure 320 is constructed analogously as described above with respect to closure 20, of FIG. 2.

Package 310 also includes sealant layers 352, 354, that provide a permanent seal or bond between side panels 312, 314 and sealing flanges 327, 329, respectively. Sealant layers 352, 354 can be provided on sealing flanges 327, 329 after first and second mating profiles 322, 324 have been manufactured; or, sealant layers 352, 354 can be co-extruded with mating profiles 322, 324. Sealant layers 352, 354 can be selectively positioned on the exterior side rectangular-shaped protrusions 342, 343, on exterior side rectangular-shaped protrusion end walls 359, 365. Sealant layers 352, 354 may be non-continuous or non-contiguous; that is, either or both of sealant layers 352, 354 can include stripes, dots, or other patterns of sealant material having areas without sealant material there between.

Sealant layers 352, 354 are typically activated, to bond sealing flanges 327, 329 to side panels 312, 314, by the application of heat and pressure over time. In order to form the bond between sealing flanges 327, 329 and side panels 312, 314, sealant layers 352, 354 preferably have a melting point that is less than the melting point of both sealing flanges 327, 329 and side panels 312, 314. The material used for sealant layers 352, 354 may have a melting point of no greater than about 130° C., or about 126° C.; another material used for sealant layers 352, 354 can have a melting point of no greater than about 110° C. Examples of materials that can be used as sealant layers include EVA (ethylene-vinyl acetate copolymer), EMMA (ethylene methyl acetic acid), linear low density materials, and ionomers. Additional examples of usable materials are taught in U.S. Pat. No. 5,709,915 (Tomic et al.), incorporated herein by reference.

A peel seal 341 can be located on the first and second sealing flanges 327, 329, on the first and second distal flanges 337, 339 (not shown) or on both the first and second sealing flanges 327, 329 and first and second distal flanges 337, 339 (not shown). Further, a peel seal 341*a* may be located on the first and second side panel 312, 314. The peel seal 341 can be positioned on and secured to an interior sides of sealing flanges 327, 329 of zipper closure 320 below first and second interlocking profiles 326, 328. The peel seal 341 can be positioned on and secured to an interior side 305, 306 of distal flanges 337, 339 of zipper closure 320 above first and second interlocking profiles 326, 328 (not shown). Peel seal 341 can be positioned on interior side rectangular-shaped protrusions 346, 347.

The zipper closures 20, 120, 220, 320 of the present disclosure are designed to be interchangeable among various types and sizes of packages. For example, the same zipper closure 20, 120, 220, 320 can be used for packages that are hermetically sealed, packages that have a tamper-evident structure, and for packages that do not include a tamper-evident structure. In some embodiments, a tamper-evident pocket may be provided over slider device 30, 330 to provide evidence whether slider device 30, 330 has been moved. For packages where no peel seal is desired, the same zipper closure 20, 120, 220, 320 can be used, simply without the peel seal being activated in the final package. For packages where one or multiple peel seals are desired, the peel seals disclosed for zipper 120 and 320 are applicable and interchangeable with all zipper closures described and within the scope of this disclosure. Zipper closures 20, 120, 220, 320 can be incorporated into packages which have the zipper closure positioned in a side panel of the package rather than at an edge; in these packages, zipper closure 20, 120, 220, 320 may extend the entire length or width of the package or only partially.

Prior to being incorporated into a package, such as package 10, 310 zipper closure 20, 120, 220, 320 may be provided on a core, spool or otherwise retained and stored. Mating profiles 22, 24, 122, 124, 222, 224, 322, 324 can be interlocked for storage, can be not interlocked, or can be provided on separate cores or spools. Zipper closure 20, 120, 220, 320 can be extruded immediately prior to incorporation into a package, eliminating the need to store or otherwise handle the zipper closure.

The above specification is believed to provide a complete description of the manufacture and use of particular embodiments of the invention. Many embodiments of the invention can be made without departing from the spirit and scope of the invention.

What is claimed is:

1. A zipper closure comprising:

(a) first and second releasably interlocking closure profiles;

(b) a first sealing flange directed toward a flexible bag interior when constructed as part of a bag having an interior and extending from the first interlocking closure profile, and a second sealing flange directed toward a flexible bag interior when constructed as part of a bag having an interior and extending from the second interlocking closure profile, the first sealing flange and the second sealing flange each having a first cross-sectional width, an interior side and an opposite exterior side;

(c) a first distal flange directed away from a flexible bag interior when constructed as part of a bag and extending from the first interlocking closure profile opposite the first sealing flange, and a second distal flange directed away from a flexible bag interior when constructed as part of a bag and extending from the second interlocking closure profile opposite the second sealing flange, the first distal flange and the second distal flange each having a first cross-sectional width, an interior side and an opposite exterior side;

(d) at least two rectangular-shaped protrusions extending from each of the interior side and exterior side of the first sealing flange; the rectangular-shaped protrusions having a second cross-sectional width greater than the first sealing flange first cross-sectional width; and (e) at least one rectangular-shaped protrusion extending from each of the interior side and exterior side of the second sealing flange; the rectangular-shaped protrusions having a second cross-sectional width greater than the second sealing flange first cross-sectional width; the rectangular-shaped protrusion on the interior side of the second sealing flange constructed and arranged to mate with the two rectangular-shaped protrusions on the interior side of the first sealing flange.

2. The zipper closure according to claim 1, wherein the first sealing flange and second sealing flange each includes a plurality of rectangular-shaped protrusions on each interior and exterior side.

3. The zipper closure according to claim 1, further comprising:

(a) two rectangular-shaped protrusions extending from each of the interior side and exterior side of the first distal flange; the rectangular-shaped protrusions having a second cross-sectional width greater than the first distal flange first cross-sectional width; and (b) a rectangular-shaped protrusion extending from each of the interior side and exterior side of the second distal flange; the rectangular-shaped protrusions having a second cross-sectional width greater than the second distal flange first cross-sectional width; the rectangular-shaped protrusion on the interior side of the second distal flange constructed and arranged to mate with the two rectangular-shaped protrusions on the interior side of the first distal flange.

4. The zipper closure according to claim 3, wherein the first distal flange and second distal flange each includes a plurality of rectangular-shaped protrusions on each interior and exterior side.

5. The zipper closure according to claim 1, further comprising:

(a) a sealant layer on the exterior side rectangular-shaped protrusion of the first sealing flange; and (b) a sealant layer on the exterior side rectangular-shaped protrusion of the second sealing flange.

6. The zipper closure according to claim 1, further comprising:

(a) a peel seal on the interior side of the first and second sealing flange.

7. The zipper closure according to claim 6, wherein the peel seal is on at least one of the interior side rectangular-shaped protrusion of the first sealing flange, and the interior side rectangular-shaped protrusion of the second sealing flange.

8. The zipper closure according to claim 1, further comprising:

(a) a peel seal on the interior side of the first and second distal flange.

9. The zipper closure according to claim 8, wherein the peel seal is on at least one of the interior side rectangular-shaped protrusion of the first distal flange, and the interior side rectangular-shaped protrusion of the second distal flange.

10. A flexible, reclosable package comprising:

(a) first and second panel sections, the first and second panel sections defining a package interior;

(b) a zipper closure disposed at a mouth of the package, the zipper closure comprising:

(i) first and second releasably interlocking closure profiles;

(ii) a first sealing flange directed toward the package interior and extending from the first interlocking closure profile, and a second sealing flange directed toward the package interior and extending from the second interlocking closure profile, the first sealing flange and the second sealing flange each having a first cross-sectional width, an interior side and an opposite exterior side;

(iii) a first distal flange directed away from the package interior and extending from the first interlocking closure profile opposite the first sealing flange, and a second distal flange directed away from the package interior and extending from the second interlocking closure profile opposite the second sealing flange, the first distal flange and the second distal flange each having a first cross-sectional width, an interior side and an opposite exterior side;

(iv) at least two rectangular-shaped protrusions extending from each of the interior side and exterior side of the first sealing flange; the rectangular-shaped protrusions having a second cross-sectional width greater than the first sealing flange first cross-sectional width; and (v) at least one rectangular-shaped protrusion extending from each of the interior side and exterior side of the second sealing flange; the rectangular-shaped protrusions having a second cross-sectional width greater than the second sealing flange first cross-sectional width; the rectangular-shaped protrusion on the interior side of the second sealing flange constructed and arranged to mate with the two rectangular-shaped protrusions on the interior side of the first sealing flange.

11. The flexible, reclosable package according to claim 10, further comprising:

(a) two rectangular-shaped protrusions extending from each of the interior side and exterior side of the first distal flange; the rectangular-shaped protrusions having a second cross-sectional width greater than the first distal flange first cross-sectional width; and (b) a rectangular-shaped protrusion extending from each of the interior side and exterior side of the second distal flange; the rectangular-shaped protrusions having a second cross-sectional width greater than the second distal flange first cross-sectional width; the rectangular-shaped protrusion on the interior side of the second distal flange constructed and arranged to mate with the two rectangular-shaped protrusions on the interior side of the first distal flange.

12. The flexible, reclosable package according to claim 10, further comprising:

(a) a sealant layer on the exterior side rectangular-shaped protrusion of the first sealing flange, the sealant layer securing the first panel section to the exterior side rectangular-shaped protrusion of the first sealing flange; and (b) a sealant layer on the exterior side rectangular-shaped protrusion of the second sealing flange, the sealant layer securing the second panel section to the exterior side rectangular-shaped protrusion of the second sealing flange.

13. The flexible, reclosable package according to claim 10, further comprising:

(a) a peel seal on the interior side of the first and second sealing flange.

14. The flexible, reclosable package according to claim 10, further comprising:

(a) a peel seal on the interior side of the first and second distal flange.

15. The flexible, reclosable package according to claim 10, further comprising:

(a) a slider device operably mounted on the zipper closure.

16. A method of making a flexible reclosable package, the method comprising:

(a) extruding a first closure profile, the first closure profile comprising:

(i) a first interlocking profile;

(ii) a first sealing flange directed toward a flexible bag interior when constructed as part of a bag having an interior and extending from the first interlocking closure profile, the first sealing flange having a first cross-sectional width, an interior side and an opposite exterior side;

(iii) a first distal flange directed away from a flexible bag interior when constructing a bag and extending from the first interlocking closure profile opposite the first sealing flange, the first distal flange having a first cross-sectional width, an interior side and an opposite exterior side;

(iv) at least two rectangular-shaped protrusions extending from each of the interior side and exterior side of the first sealing flange; the rectangular-shaped protrusions having a second cross-sectional width greater than the first sealing flange first cross-sectional width;

(b) extruding a second closure profile, the second closure profile comprising:

(i) a second interlocking profile, the second interlocking profile constructed and arranged to interlock with the first interlocking profile;

(ii) a second sealing flange directed toward a flexible bag interior when constructed as part of a bag having an interior and extending from the second interlocking closure profile, the second sealing flange having a first cross-sectional width, an interior side and an opposite exterior side;

(iii) a second distal flange directed away from a flexible bag interior when constructing a bag and extending from the first interlocking closure profile opposite the second sealing flange, the second distal flange having a first cross-sectional width, an interior side and an opposite exterior side;

(iv) at least one rectangular-shaped protrusion extending from each of the interior side and exterior side of the second sealing flange; the rectangular-shaped protrusions having a second cross-sectional width greater than the second sealing flange first cross-sectional width; the rectangular-shaped protrusion on the interior side of the second sealing flange constructed and arranged to mate with the two rectangular-shaped protrusions on the interior side of the first sealing flange;

(c) providing a sealant layer on the exterior side rectangular-shaped protrusion of the first and second sealing flange;

(d) securing a first panel section to the sealant layer on the exterior side rectangular-shaped protrusion of the first sealing flange;

(e) securing a second panel section to the sealant layer on the exterior side rectangular-shaped protrusion of the second sealing flange; and (g) joining the first panel section to the second panel section at first and second panel sides and bottom edge.

17. The method according to claim 16, further comprising:

(a) providing a peel seal on the first and second closure profile.

18. The method according to claim 17, wherein providing a peel seal comprises providing the peel seal on the first and second sealing flange.

19. The method according to claim 17, wherein providing a peel seal comprises providing the peel seal on the first and second distal flange.

20. The method according to claim 17, wherein providing a peel seal comprises providing a peel seal on at least one of the interior side rectangular-shaped protrusion of the first sealing flange, and the interior side rectangular-shaped protrusion of the second sealing flange.

* * * * *